US009963769B2

(12) United States Patent
Prest et al.

(10) Patent No.: US 9,963,769 B2
(45) Date of Patent: May 8, 2018

(54) SELECTIVE CRYSTALLIZATION OF BULK AMORPHOUS ALLOY

(75) Inventors: Christopher D. Prest, San Francisco, CA (US); Matthew S. Scott, Campbell, CA (US); Stephen P. Zadesky, Portola Valley, CA (US); Dermot J. Stratton, San Francisco, CA (US); Joseph C. Poole, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 280 days.

(21) Appl. No.: 13/541,842

(22) Filed: Jul. 5, 2012

(65) Prior Publication Data

US 2014/0007989 A1 Jan. 9, 2014

(51) Int. Cl.

| | |
|---|---|
| ***C22C 1/00*** | (2006.01) |
| ***C22C 45/00*** | (2006.01) |
| ***C22F 1/00*** | (2006.01) |

(52) U.S. Cl.

CPC . *C22F 1/00* (2013.01); *C22C 1/00* (2013.01)

(58) Field of Classification Search

None

See application file for complete search history.

(56) References Cited

U.S. PATENT DOCUMENTS

| | | | | |
|---|---|---|---|---|
| 4,347,086 | A * | 8/1982 | Chraplyvy et al. | 148/101 |
| 5,288,344 | A | 2/1994 | Peker | |
| 5,368,659 | A | 11/1994 | Peker | |
| 5,618,359 | A | 4/1997 | Lin | |
| 5,705,234 | A * | 1/1998 | Yamamoto et al. | 427/540 |
| 5,735,975 | A | 4/1998 | Lin | |
| 5,808,233 | A * | 9/1998 | Finkel et al. | 136/200 |
| 6,325,868 | B1 | 12/2001 | Kim | |
| 6,387,530 | B1 * | 5/2002 | Liu et al. | 428/559 |
| 7,575,040 | B2 | 8/2009 | Johnson | |
| 2003/0118751 | A1 * | 6/2003 | Van Den Broek et al. | 428/1.4 |
| 2005/0263216 | A1 * | 12/2005 | Chin et al. | 148/304 |
| 2006/0065020 | A1 * | 3/2006 | Pai | C03B 11/086 65/374.11 |
| 2007/0079907 | A1 | 4/2007 | Johnson | |
| 2008/0118387 | A1 | 5/2008 | Demetriou | |
| 2008/0125848 | A1 * | 5/2008 | Kusleika et al. | 623/1.11 |
| 2008/0135136 | A1 | 6/2008 | Demetriou | |

(Continued)

FOREIGN PATENT DOCUMENTS

| | | | |
|---|---|---|---|
| JP | 5517526 A | | 2/1980 |
| JP | 55017526 A | * | 2/1980 |
| JP | 2001-303218 | | 10/2001 |

OTHER PUBLICATIONS

Black, J.T., "Introduction to Machining Processes", Metals Handbook, Ninth Edition, vol. 16: Machining, ASM International, 1989, 4 pp.*

(Continued)

*Primary Examiner* — George Wyszomierski

(74) *Attorney, Agent, or Firm* — Brownstein Hyatt Farber Schreck, LLP

(57) ABSTRACT

Provided in one embodiment is a method of selective microstructural transformation, comprising: providing a part comprising a bulk amorphous alloy; heating selectively a portion of the part to a first temperature such that at least some of the portion is transformed into a crystalline phase; and processing the transformed portion.

25 Claims, 5 Drawing Sheets

(56) References Cited

U.S. PATENT DOCUMENTS

| | | | | |
|---|---|---|---|---|
| 2009/0162629 | A1 | 6/2009 | Demetriou | |
| 2010/0079970 | A1* | 4/2010 | Prest | B29C 65/645 361/807 |
| 2010/0084052 | A1 | 4/2010 | Farmer | |
| 2010/0230012 | A1 | 9/2010 | Demetriou | |
| 2010/0300148 | A1 | 12/2010 | Demetriou | |
| 2012/0132625 | A1* | 5/2012 | Kaltenboeck et al. | 219/121.11 |

OTHER PUBLICATIONS

Inoue et al., "Bulk amorphous alloys with high mechanical strength and good soft magnetic properties in Fe—Tm—B (Tm=IV-VIII group transition metal) system", Appl. Phys. Lett., vol. 71, p. 464 (1997).

Shen Et., "Bulk Glassy CO43FE2OTA5.5B31.5 Alloy with High Glass-Forming Ability and Good Soft Magnetic Properties", Materials Transactions, vol. 42 No. 10 (2001) pp. 2136-2139.

* cited by examiner

SELECTIVE CRYSTALLIZATION OF BULK AMORPHOUS ALLOY

All publications, patents, and patent applications cited in this Specification are hereby incorporated by reference in their entirety.

BACKGROUND

Over the last two decades, amorphous alloys, or metallic glasses, have received increasing attention because of their unique characteristics, such as high strength, high specific strength, large elastic strain limit, excellent wear and corrosion resistance, along with other remarkable engineering properties. Because of the promise shown by these materials, researchers have designed a multitude of multi-component systems that form amorphous glassy alloys, among which Zr-based bulk metallic glasses ("BMGs") have been utilized commercially to produce a variety of items, including, for example, sporting goods, electronic casings, and medical devices.

However, the same high hardness, high corrosion resistance, and high fracture resistance are properties that make this class of materials desirable can also make the post-fabrication processing of these materials difficult. For example, because BMG are highly resistant to chemical corrosion, a strong, very corrosive etchant would be needed for etching. Likewise, because metallic glasses have very high hardness and strength, more energy would be needed to process mechanically the metallic glasses, such as, for example, polishing, grinding, and punching a hole. This issue can become particularly challenging when only a small portion of a part made of a metallic glass is to be processed (e.g., machined). Namely, while one might want to weaken the small portion of the metallic glass part to facilitate processing, one would not want to alter the part as a whole to sacrifice the desired properties of the metallic glass.

Thus, a need exists to selectively create regions on a metallic glass part with a different property than the remainder of the part, so that the localized difference in material property can facilitate the processing of the part.

SUMMARY

One embodiment provides a method of selective microstructural transformation, comprising: providing a part comprising a bulk amorphous alloy; heating selectively a portion of the part to a first temperature such that at least some of the portion is transformed into a crystalline phase; and processing the transformed portion.

An alternative embodiment provides a method of processing a bulk amorphous alloy part, comprising: heating selectively a portion of a surface of the part to a first temperature such that at least some of the portion is transformed into a crystalline phase, wherein the transformed portion has a lower mechanical strength than the non-transformed portion; and processing the transformed portion.

Another embodiment provides a method of patterning, comprising: providing a part comprising a bulk amorphous alloy; heating selectively a portion of a surface of the part to a first temperature to transform at least some of the portion into a crystalline phase; and forming at least one feature on the transformed portion.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
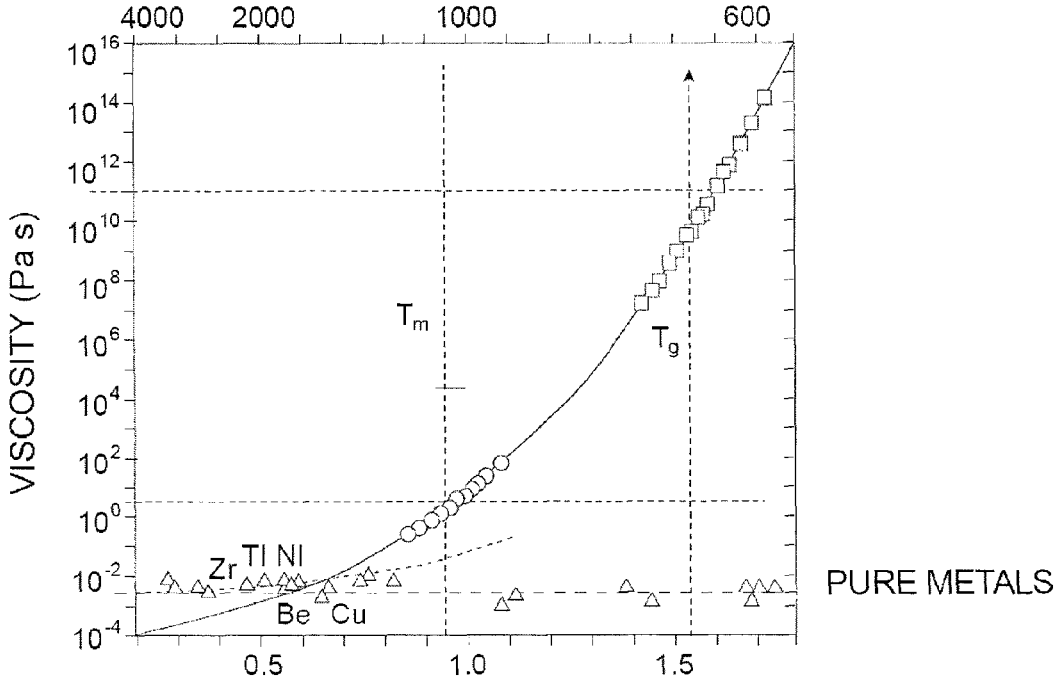
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
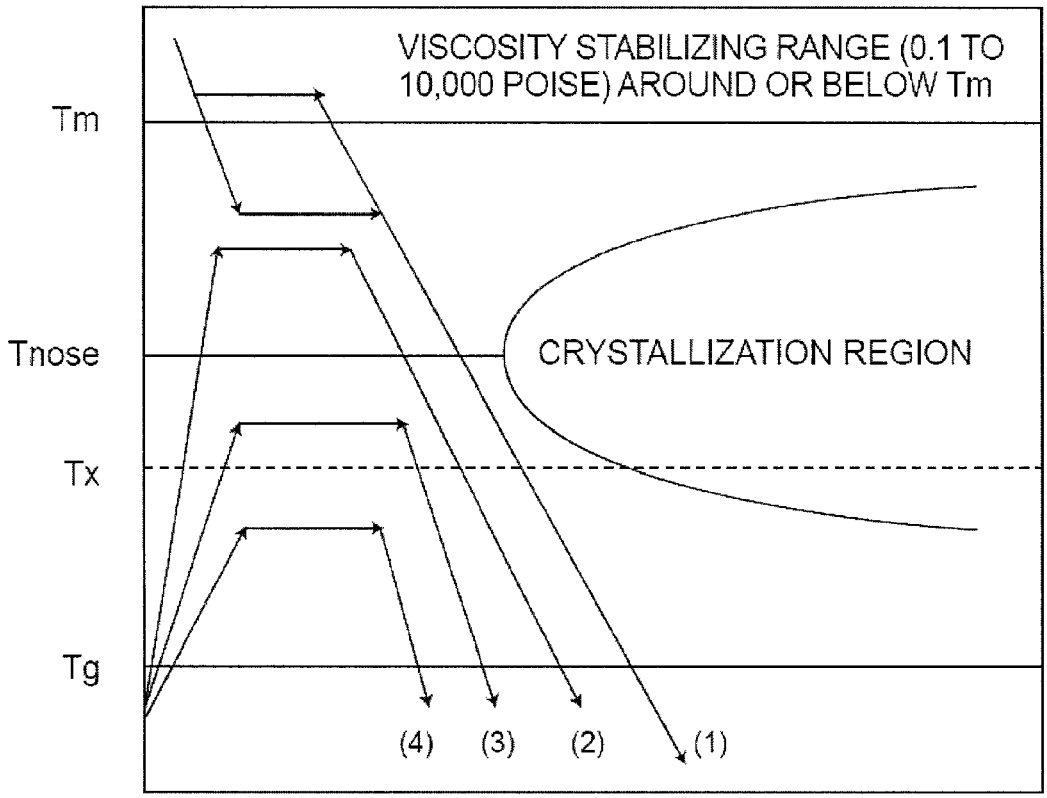
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, ununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 5 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo-Ln-C—B, Fe—Mn—Cr—Mo—(Y,Ln)—C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Cu4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Selective Crystallization

As aforedescribed, a metallic glass, such as a BMG, can have material properties more desirable than its conventional crystalline counterpart. The material properties can refer to both a physical property, such as mechanical property, and a chemical property, such as corrosion resistance. "Mechanical strength" here can refer to several mechanical properties of a material. For example, it can refer to yield strength, ultimate failure strength, hardness, fatigue life, fatigue fracture resistance, elastic limit, or combinations thereof.

In addition to having a higher mechanical strength, a metallic glass is also known to have higher resistance to chemical and/or stress corrosion and superior electrical and thermal properties, including higher electrical conductivity. A metallic glass and a conventional crystalline alloy also can exhibit distinct temperature dependence for several of their material properties, including, for example, electrical resistivity. For instance, in one embodiment a metallic glass can show relative temperature independence of the electrical resistivity with increasing temperature at least until the crystallization temperature, whereas these properties of a polycrystalline alloy can be highly dependent on the increase in temperature.

Figure 3:
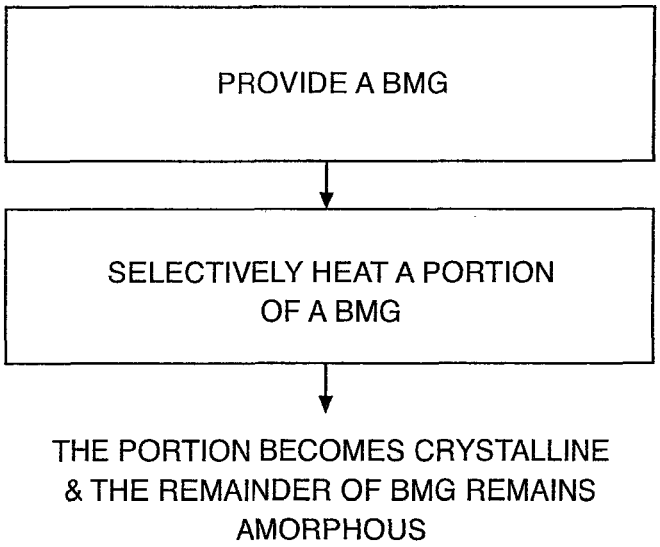
FIG. 3 shows a flowchart showing the steps of processing and microstructural transformation in one embodiment.

In the case of a BMG, while in many circumstances the difference tends to point to the desirability of an amorphous phase (and thus the undesirability of the crystalline phase) in a structural component, the presence of a crystalline phase can sometimes be beneficial, particularly during processing of a BMG part (or a BMG-containing part). In particular, because a crystalline phase generally can have a lower mechanical strength than an amorphous phase, it can be desirable to control the presence of the crystalline phase in a BMG-containing part to facilitate the processing of the part. For example, it would take a lot more effort to remove a portion of a BMG (e.g., by etching or machining) or to create a pattern on a BMG than a crystalline alloy because the former is much stronger (and/or more resistant to chemical attack) than the latter. However, the effort can be significantly reduced if the portion to be removed and/or patterned is first converted into a crystalline phase. Such controlled, selective microstructural transformation can be beneficial to processing of a metallic glass. FIG. 3 provides a flowchart showing the steps of selective microstructural transformation to facilitate post-fabrication processing of a BMG-containing part in one illustrative embodiment.

Provided in one embodiment is a method of processing a structural part containing a bulk metallic glass by selective microstructural transformation. The part here can refer to any structural component that can be used in any suitable application. For example, the part can be a component of a device, such as a mechanical device, electronic device, or medical device, or it can be a structural component of any structure. The part can comprise a bulk amorphous alloy (or BMG). Alternatively, the part can consist essentially of a BMG. In another embodiment, the part can consist of a BMG. The BMG can have any of the aforedescribed amorphous alloy compositions with any of the aforedescribed properties and dimensions.

The microstructural transformation in many embodiments can be selective. A selective transformation (and processing) can refer to a transformation/processing process that is controlled with respect to processing parameter, time, location, etc., as described below. The transformation can be performed by any techniques that may transform an alloy of amorphous phase into one of crystalline phase (i.e., "crystallization") or transform an alloy of a crystalline phase into an amorphous phase (i.e., "amorphization"). In some of the embodiments, the microstructural transformation described herein refers to crystallization. In some embodiments, the chemical composition of the alloy undergoing a microstructural transformation can remain fairly the same, or is substantially the same, although in some cases slight variations may be possible.

The techniques that can induce the microstructural transformation can be any one in the art known to cause such a transformation. For example, crystallization in a BMG part can be induced by heating. In one embodiment, the transformation can be induced by selectively heating a predetermined portion of the BMG to a first elevated temperature to allow movement of the atoms of the alloy, and, as a result, crystallization thereof. The portion can be any portion of the BMG part where the user would like to crystallize. Thus, the crystallization can be selective in the sense that the location and parameters (of transformation technique) for the crystallization are pre-determined and/or controlled by an operator. For example, the portion can be on a surface of the BMG part. In one embodiment, substantially all of the part is heated to allow the microstructural transformation therein. In one embodiment, the party in its entirety is heated to allow the microstructural transformation therein. In the embodiment wherein the portion refers to a portion on the surface as shown in, for example, FIG. 4(*b*), the portion can refer to any portion of the surface. For example, it can refer to a portion of the surface, substantially all of the surface, or the entire surface of the BMG part.

Figure 5:
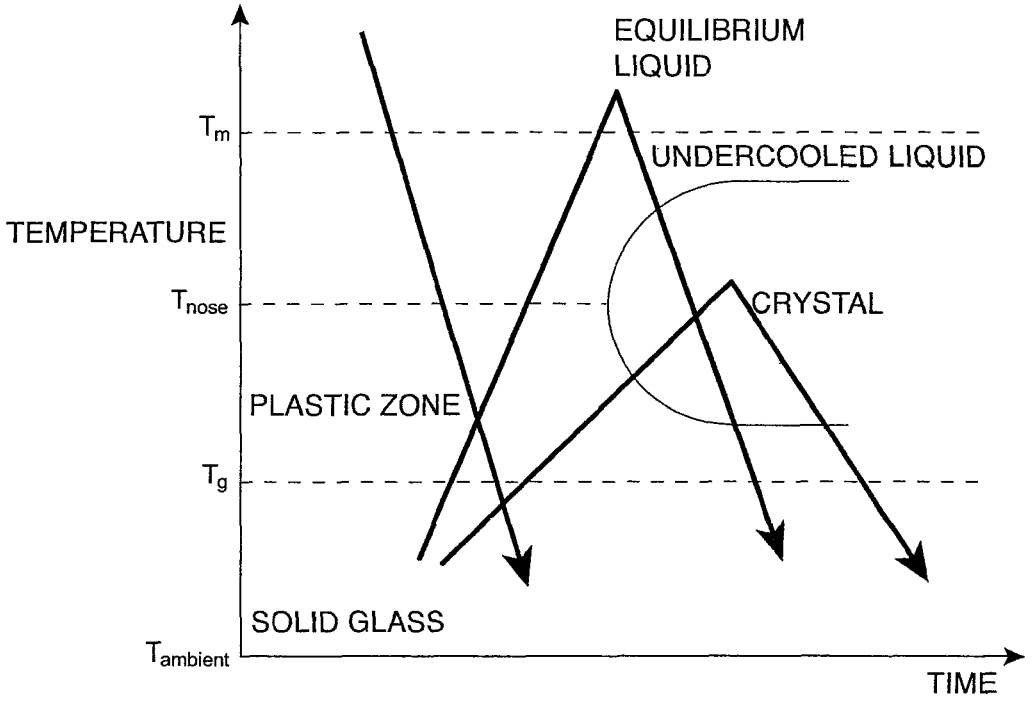
FIG. 5 provides an illustration of a TTT-diagram that can demonstrative some exemplary paths of crystallizing at least certain portions of an amorphous alloy.

The transformation from crystallization state to an amorphous state, and vice versa, can be illustrated using a Time-Temperature-Transformation ("TTT") diagram. An illustrative TTT-diagram is shown in FIG. 5. It is understood that if the temperature of an amorphous metal/alloy is dropped below the melting temperature $T_m$ of the alloy, the alloy can crystallize if not quenched to the glass transition temperature $T_g$ before the elapsed time exceeds a critical value, $t_x(T)$. This critical value is given by the TTT-diagram and depends on the undercooled temperature. Accordingly, the BMG must be initially cooled sufficiently rapidly from above the melting point to below the glass transition temperature $T_g$ sufficiently fast to bypass the "nose region" of the material's TTT-diagram ($T_{nose}$, which represents the temperature for which the minimum time to crystallization of the alloy will occur) and avoid crystallization (as shown by the path 31 in FIG. 5). On the other hand, to crystallize a previously amorphous alloy, the temperature of the alloy can be raised to either the crystallization region (inside the nose) and cooled (path 32), or it can be raised to above the melting temperature (to be remelted) and recooled slowly to enter the crystallization region (e.g., path 33). The TTT-diagram in FIG. 5 is merely for illustration purpose and many other paths might exist.

The heating can be carried out by any suitable technique that can raise the temperature of an object. In one embodiment, the heating can be applied to at least substantially all of a BMG-containing part, such as the entire part, so that at least a substantial portion of the part is brought to an elevated temperature. Alternatively, the heating can be localized heating, and only a predetermined, selected portion of the part is heated. The location to which the heating is applied need not be where the BMG is present in the part. For example, in one embodiment, as long as the temperature the BMG in the part experiences in the part is sufficiently high (e.g., at or higher than the first temperature described above) to allow transformation, the heating can be applied anywhere on the part.

In one embodiment wherein localized heating is used, only the surface region of the part is heated to the first temperature. The region can refer to the top 50 microns or more, such as 100 microns or more, such as 200 microns or more, such as 400 microns or more, such as 800 microns or more, such as 1 mm or more, such as 1.5 mm or more, such as 2 mm or more, such as 5 mm or more, such as 1 cm or more, such as 5 cm or more, such as 10 cm or more. In one embodiment, this dimension can refer to a diameter of the region, if the region has a circular shape. Alternatively, this dimension can refer to the depth. In one embodiment, as noted previously, the entire BMG part is heated if it is desired to crystallize the entire part, or a substantial portion of the part.

In one embodiment, at least substantially all of the BMG part and/or tools involved in the presently described methods can be heated to the first temperature. Not to be bound by any particular theory, but during heating the atoms that are previously "frozen" in the amorphous alloy phase can begin to move and to rearrange themselves to establish a certain lattice periodicity—e.g., to establish crystallinity at least in certain regions. The heating step can involve any suitable techniques, such as with a laser, inductive heating, conductive heating, flash lamp, electron discharge, or combinations thereof. In one further embodiment, the heating can be carried out by any suitable heat source, such as laser heating, plasma heating, infrared heating, irradiation, conductive contact heating, frictional heating, direct electrical resistive heating in the part (e.g. as in spot welding) or combinations thereof.

The heating can be continuous or can be intermittent and/or repetitive. For example, in one embodiment, the heating can be conducted by applying laser to the desired region for a predetermined period of time. Alternatively, a pulse laser type of cyclic heating can be applied to the desired region and repeatedly heat the region. The pulse can vary depending on the applications. The heating time can depend on the chemical composition of the alloy. For example, the heating time can be less than or equal to 250 seconds, such as less than or equal to 200 seconds, such as less than or equal to 150 seconds, such as less than or equal to 100 seconds, such as less than equal to 50 seconds.

The entire heated region/portion need not be transformed. For example, in some embodiments, only a fraction of the region being heated undergoes microstructural transformation. Not to be bound by any particular theory, but this could be due to thermal gradient, for example. This can be particularly prominent when a localized heating technique is applied to the region. In one embodiment, substantially all of the region heated undergoes the microstructural transformation. In another embodiment, the entire heated region undergoes the transformation. In another embodiment, only a portion of the region heated undergoes the transformation.

The temperature the portion (or the part as a whole, or a substantial portion of the part) is heated to (i.e., the aforementioned "first temperature") can vary, depending on the alloy system used. In one embodiment, the temperature can be below a crystallization temperature Tx of the alloy, or at about Tx, or above Tx. Probably higher is better (material will crystallize more rapidly, lower processing time. For example, the first temperature can be at least 500 to 700 C. The heated portion can subsequently be cooled so that at least one crystal can form. In the case of more than one crystal is formed, the region can become polycrystalline.

The cooling can be carried by conductive contact (e.g. with a cold, highly thermally conductive block, gas (Helium has high thermal diffusivity) or liquid (e.g. oil) cooling. High cooling rate is preferable, likely to lead to more predictable Heat affected Zone shape. It might be preferable to actively cool the sample while heat is being applied, e.g., blast helium at the part, and laser heat certain regions. This would help localize the heating to the required areas and avoid heat build up in the part after long heating runs. The cooling time can depend on the chemical composition of the alloy. For example, the cooling time can be less than or equal to 250 seconds, such as less than or equal to 200 seconds, such as less than or equal to 150 seconds, such as less than or equal to 100 seconds, such as less than equal to 50 seconds. The cooling step can be carried out at rates different from or similar to the heating rates at the heating step. The cooling rate can be carried out at a rate higher than, lower than, or the same as, the heating rate at the heating step.

The heating, cooling, and/or processing (described below) can be repeated, if needed, and can take place at a different temperature (i.e., "second temperature," "third temperature," etc.) and heated/cooled at different rates. The transformation can also be repeated at a plurality of regions on the part, by repeating, for example, the heating and cooling steps on a plurality of different regions on the part (i.e., "second portion/region," "third portion/region"). The transformation can also be applied to the same region. For example, the crystallized portion can be amorphitized, and vice versa. Alternatively, the crystallized portion can be further transformed to increase/decrease the degree of crystallinity in that region.

In one embodiment, laser heating, which is followed by slow cooling, can be applied to at least a portion of a BMG part. In another embodiment, plasma heating, which is followed by slow cooling, can be applied to a portion of a BMG, and the portion is at the surface of the part. In another embodiment, infrared with reflective marks, which is followed by slow cooling, can be applied to a portion of a BMG, and the portion is at the surface of the part. In some embodiments, "slow" cooling therein refers to cooling rate low enough not to allow the alloy to form a glass again (if heating goes above the melting temperature), probably not a big concern in this context because we would not heat to Tm for metallic glass.

Because of the differences with respect to the material properties between a crystalline phase and an amorphous phase of an alloy, the crystallized portion can facilitate post-fabrication processing of the BMG-containing part. A BMG-containing part herein can refer to a structural component of a device, such as an electronic device. The post-fabrication processing in some embodiments herein is referred to as "processing" for short. In one embodiment, processing can include finishing, painting, polishing, grinding, smoothing, machining, blasting, or combinations thereof. The processing can also include patterning. For example, the (transformed) mechanically weaker region can be patterned to create a certain feature (surface or internal). Any desirable feature (e.g., grooves, marks, surface morphology, etc.) can be created. In one embodiment, the processing steps described herein can be integrated with a fabrication method of a BMG part.

The transformed and/or processed portion can be functionally different from the non-transformed portion. For example, because of the weaker mechanical strength and higher susceptibility to chemical corrosion of the crystalline phase than the amorphous phase, the transformed, crystalline region can be processed and/or patterned. The process/patterned portion then can have a different function from the non-processed part. For example, in one embodiment, the transformed region can become mechanically weaker than the rest of the amorphous BMG part. The weakness can then facilitate machining of the transformed region, such as allowing a hole to be created by punching through the transformed region. Alternatively, the transformed region can be further processed to create threads inside of the BMG-containing part. Alternatively, the transformed part can be removed.

Figure 4:
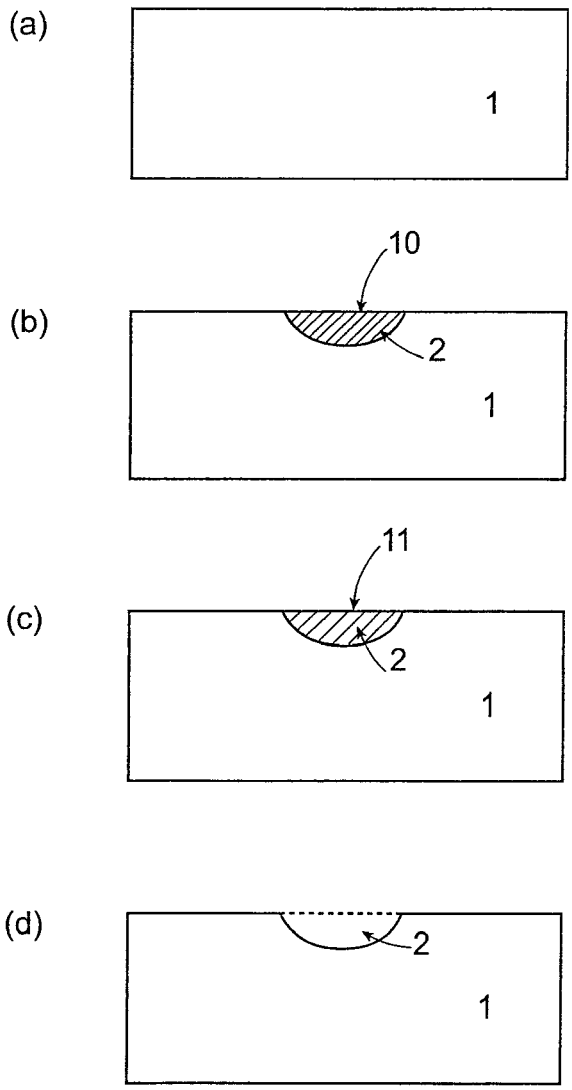
FIGS. 4(*a*)-4(*d*) illustrate an embodiment wherein a region in BMG is microstructurally transformed into a crystalline phase and the region is subsequently removed by etching.

The surface property, such as the surface morphology, of the BMG-containing part in the transformed region can also be different from the remaining non-transformed (i.e., amorphous) region as a result of the microstructural transformation. In one embodiment, because of the increase in susceptibility to chemical corrosion (i.e., decrease in resistance to chemical attack), the transformed region can be etched away or etched to create a surface feature, such as a pattern. FIGS. 2(*a*)-2(*d*) illustrate such an etching process. The BMG 1 is first microstructurally transformed in region 2 by a heat source 10; see FIGS. 2(*a*)-2(*b*). The region then becomes at least partially crystalline. The region 2 then is etched by an etching process with etchant 11, as shown in FIG. 4(*c*). Finally, the region 2 is etched away, leaving a cavity, as shown in FIG. 4(*d*). Any suitable etchant and etching technique commonly used to etch the alloy can be applied. Note that the location of the etching is not limited to what is shown in the figure, and instead can be anywhere on the part. For example, the part can be etched at its bottom to create at least one undercut. Alternatively, the part can be etched on its side(s) and/or top surface(s).

The feature can also be created by mechanical force, such as by scratching, carving, and the like. The feature need not be a cavity. For example, it can be a pattern, such as a surface pattern. The pattern can be a logo, a word, a phrase, a symbol, a picture, a trademark, or any specific desired geometry feature. The pattern can be an one-dimensional, two-dimensional, or three-dimensional, or a combination thereof. For example, the region 2 in FIG. 4 can be selectively etched to form the aforedescribed pattern (instead of a cavity). The pattern in region 2 can also be formed by mechanical force, as aforedescribed. It is noted that in addition to the transformed region, the non-transformed region can also be further processed by methods and techniques, such as those suitable for metallic glasses.

The feature can also be a component that is functionally different from the remainder (i.e., amorphous phase) of the BMG-containing part. In one embodiment the feature formed in the transformed region can serve a different function than the non-transformed amorphous region. One of the surprising advantages of the selective transformation/processing methods described herein over some pre-existing crystallization on as-deposited thin film is that the presently described methods can create features that are three-dimensional, such as the aforementioned logos, trademarks, geometries, etc. In one embodiment, the feature can also be two-dimensional or one-dimensional. Specifically, because the pre-existing/traditional as-deposited films are mostly very thin (i.e., a few microns at most), the crystallization, and the subsequent processing, is thus restricted and limited by the small dimensions—the bulk metallic glasses described here do not suffer this drawback. Further, the as-deposited thin film is not a "bulk" component in the sense of the presently described BMG with the much larger dimensions.

What is claimed:

1. A method, comprising:

crystallizing a portion of a bulk amorphous alloy part, the portion being less than the entire part; and removing substantially all of the crystallized portion by machining a local portion of the part, the local portion including less than an entire surface of the part, thereby forming an at least partially amorphous part.

2. The method of claim 1, wherein the bulk amorphous alloy comprises at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg.

3. The method of claim 1, wherein the operation of crystallizing the portion of the part comprises heating the portion of the part using laser heating, plasma heating, infrared heating, conductive contact heating, frictional heating, direct electrical resistive heating in the part, or combinations thereof.

4. The method of claim 3, wherein the operation of heating the portion of the part comprises heating the portion of the part to a temperature at or above a crystallization temperature of the bulk amorphous alloy.

5. The method of claim 3, further comprising cooling the heated portion.

6. The method of claim 1, wherein the crystallized portion is on a surface of the part.

7. The method of claim 1, wherein the crystallized portion has at least one material property different from an amorphous portion of the part.

8. The method of claim 1, wherein machining the local portion of the part comprises forming a cavity in the surface of the part.

9. The method of claim 8, wherein machining the local portion of the part further comprises forming threads in the cavity.

10. A method, comprising:

heating a portion of a part comprising a bulk amorphous alloy to a first temperature to form a transformed portion of the part comprising a crystalline phase, wherein the transformed portion is adjacent a non-transformed portion of the part and has a lower mechanical strength than the non-transformed portion; and removing substantially all of the transformed portion using a mechanical removal operation to form a cavity in a surface of the part.

11. The method of claim 10, wherein the lower mechanical strength comprises lower yield strength, lower hardness, lower fatigue life, lower fatigue fracture resistance, lower elastic limit, or combinations thereof.

12. The method of claim 10, further comprising repeating at least one of the heating operation and the removing operation on a different portion of the part.

13. The method of claim 10, wherein removing substantially all of the transformed portion comprises forming threads in the transformed portion.

14. The method of claim 10, further comprising finishing, painting, polishing, or combinations thereof the part after the removal operation.

15. The method of claim 10, wherein the transformed portion has a surface morphology that is different from that of the non-transformed portion.

16. The method of claim 10, wherein the part is a part of an electronic device.

17. The method of claim 10, wherein the operation of removing substantially all of the transformed portion comprises punching a hole through the transformed portion.

18. The method of claim 10, wherein a threaded opening is machined in the transformed portion of the part during the mechanical removal operation.

19. A method, comprising:

crystallizing a portion of a bulk amorphous alloy part that is less than the entire part; and forming a cavity in a surface of the part by machining away substantially all of the crystallized portion.

20. The method of claim 19, wherein the bulk amorphous alloy is substantially free of Ni, Be, or both.

21. The method of claim 19, wherein the part is a part of an electronic device.

22. The method of claim 19, wherein machining away substantially all of the crystallized portion comprises grinding the crystallized portion.

23. The method of claim 19, wherein the operation of forming the cavity comprises forming a cavity with an undercut.

24. The method of claim 19, wherein the cavity extends through less than a complete thickness of the part.

25. The method of claim 19, wherein the portion of the bulk amorphous alloy part comprises substantially an entire surface region of the part.

* * * * *